US008479824B2

(12) United States Patent
Travis et al.

(10) Patent No.: US 8,479,824 B2
(45) Date of Patent: Jul. 9, 2013

(54) POWER SLIP ASSEMBLY FOR WELLHEAD CASING AND WELLBORE TUBING

(75) Inventors: Todd Travis, Humble, TX (US); Elizabeth A. McClain, Houston, TX (US); Paul Perez, Sugar Land, TX (US); Brandon M. Cain, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 266 days.

(21) Appl. No.: 12/565,009

(22) Filed: Sep. 23, 2009

(65) Prior Publication Data

US 2010/0084136 A1 Apr. 8, 2010

Related U.S. Application Data

(60) Provisional application No. 61/102,056, filed on Oct. 2, 2008.

(51) Int. Cl.
*E21B 19/00* (2006.01)
*E21B 23/00* (2006.01)

(52) U.S. Cl.
USPC ..... 166/344; 166/360; 166/368; 166/75.13; 285/123.5

(58) Field of Classification Search
USPC ..... 166/344, 338, 339, 351, 360, 368, 166/378–381, 75.13; 285/369, 417, 18, 86, 285/123.1, 123.3, 123.5, 123.11
See application file for complete search history.

(56) References Cited

U.S. PATENT DOCUMENTS

| | | | | | |
|---|---|---|---|---|---|
| 3,095,627 | A | * | 7/1963 | Johnson | 188/67 |
| 3,382,921 | A | * | 5/1968 | Todd | 166/348 |
| 3,638,725 | A | * | 2/1972 | Ahlstone | 166/330 |
| 3,871,449 | A | * | 3/1975 | Ahlstone | 166/183 |
| 3,977,473 | A | * | 8/1976 | Page, Jr. | 166/382 |
| 4,496,172 | A | * | 1/1985 | Walker | 285/18 |
| 4,557,508 | A | * | 12/1985 | Walker | 285/84 |
| 4,658,901 | A | | 4/1987 | Alexander | |
| 4,708,376 | A | * | 11/1987 | Jennings et al. | 285/315 |
| 4,799,714 | A | | 1/1989 | Collet | |
| 4,828,293 | A | * | 5/1989 | Vanderford et al. | 285/123.6 |
| 4,842,061 | A | | 6/1989 | Nobileau | |

(Continued)

OTHER PUBLICATIONS

Wood Group Pressure Control, "Wellhead Housings: W2 Casing Head with S4 Surelock Connector," undated.

(Continued)

*Primary Examiner* — Matthew Buck
(74) *Attorney, Agent, or Firm* — Wong, Cabello, Lutsch, Rutherford & Brucculeri, L.L.P.

(57) ABSTRACT

A power slip extends a joint from tubing disposed in casing at a well so that a casing head can install on the casing and the tubing can be packed-off from the casing. The joint attaches to an inner sleeve having collet members that fit onto the inner tubing so that the joint extends thereabove. An outer sleeve and interlocking collet assemble together and install onto the inner sleeve. The collet threads onto the inner sleeve and forces the outer sleeve downward onto the inner sleeve. Being forced, the outer sleeve causes the collet members to engage around the inner tubing. The casing head then installs on the casing with the joint extending up through the head's bowl. An H-plate installs in the open bowl around the extended joint, and another pack-off installs on the joint to pack it off from a spool attaching to the casing head.

35 Claims, 5 Drawing Sheets

U.S. PATENT DOCUMENTS

| | | | | |
|---|---|---|---|---|
| 4,949,786 | A * | 8/1990 | Eckert et al. | 166/208 |
| 4,982,795 | A * | 1/1991 | King | 166/382 |
| 5,222,555 | A | 6/1993 | Bridges | |
| 5,287,925 | A | 2/1994 | Watkins et al. | |
| 5,301,750 | A * | 4/1994 | Watkins | 166/208 |
| 5,360,063 | A | 11/1994 | Henderson, Jr. | |
| 5,439,061 | A | 8/1995 | Brammer et al. | |
| 6,035,938 | A * | 3/2000 | Watkins | 166/345 |
| 6,102,626 | A | 8/2000 | Milberger | |
| 6,123,363 | A * | 9/2000 | Burgard et al. | 285/24 |
| 6,311,792 | B1 * | 11/2001 | Scott et al. | 175/162 |
| 6,447,021 | B1 * | 9/2002 | Haynes | 285/302 |
| 6,516,876 | B1 * | 2/2003 | Jennings | 166/77.51 |
| 6,609,731 | B2 * | 8/2003 | DeBerry et al. | 285/123.4 |
| 6,609,734 | B1 * | 8/2003 | Baugh | 285/322 |
| 6,761,221 | B1 * | 7/2004 | Yokley et al. | 166/382 |
| 6,820,698 | B2 * | 11/2004 | Haynes | 166/381 |
| 6,824,171 | B2 * | 11/2004 | Milberger et al. | 285/123.13 |
| 7,040,407 | B2 * | 5/2006 | Jennings et al. | 166/348 |
| 7,503,391 | B2 * | 3/2009 | McCanna et al. | 166/343 |
| 7,614,453 | B2 * | 11/2009 | Spiering et al. | 166/338 |
| 7,686,087 | B2 * | 3/2010 | Pallini et al. | 166/367 |
| 7,699,354 | B2 * | 4/2010 | Beard et al. | 285/123.13 |
| 2003/0029621 | A1 | 2/2003 | Haynes | |
| 2009/0120648 | A1 | 5/2009 | Khazanovich et al. | |

OTHER PUBLICATIONS

Bowes, C. & Procter, R., "1997 Driller's Stuck Pipe Handbook," 1997.

Examiner's First Report in counterpart Australian Appl. No. 2009222441, dated Feb. 25, 2011.

Examiner's Requisition in counterpart Canadian Appl. No. 2,680,428, dated Mar. 24, 2011.

Notice of Allowance in counterpart Canadian Appl. No. 2,680,428, dated Jun. 20, 2011.

Second Examination Report in counterpart Australian Appl. No. 2009222441, dated May 10, 2012.

* cited by examiner

POWER SLIP ASSEMBLY FOR WELLHEAD CASING AND WELLBORE TUBING

CROSS-REFERENCE TO RELATED APPLICATIONS

This is a non-provisional application of U.S. Provisional Appl. Ser. No. 61/102,056, filed 2 Oct. 2008, which is incorporated herein by reference and to which priority is claimed.

BACKGROUND

A wellhead can be damaged when the exposed casing becomes bent. To fix the problem, operators remove the existing wellhead and cut-down the exposed casing so that a new wellhead can be installed. However, installing the new wellhead presents several challenges. For example, some wells have inner tubing disposed inside the outer casing exposed at the well. In this situation, the operators need to install a "no-weld" casing head (also known as a sleeve-type casing head) on the cut-down casing and need to isolate the inner tubing from the outer casing.

In other problem situations at a well, a wellbore tubular (e.g., drill pipe, collar, casing, or other tubular) may become stuck during drilling, running, or hoisting. Because operators cannot pull the stuck pipe from the casing, the operators must use slip hangers to support the stuck pipe so the pipe can be left in place. Unfortunately, operators must set the slips to support the stuck pipe even though the wellhead (e.g., BOP, diverter, casing head, etc.) is already installed on the surrounding casing.

In one conventional method of setting such slips, operators unbolt the BOP/Diverter from the wellhead's casing head and raise the BOP/Diverter slightly so the operators can gain access inside the casing head. At this point, the operators can set the slips in the casing head and pull on the stuck pipe to engage it further on the slips. Once set, operators bring the BOP/Diverter back down and bolt it to the casing head. As expected, performing this operation by suspending several tons of equipment overhead while operators set slips and test the integrity of seals is time-consuming and difficult. Some other methods of setting slips to suspend a stuck pipe are disclosed in U.S. Pat. Nos. 4,982,795 and 5,301,750, which do not require the removal of the BOP/Diverter.

The subject matter of the present disclosure is directed to overcoming, or at least reducing the effects of, one or more of the problems set forth above.

SUMMARY

A wellbore tubular slip apparatus is used for a wellhead when operators install a "no-weld" casing head (also known as sleeve type casing head), on a casing and inner tubular at a well site. To install the no-weld casing head, operators need to be able to secure and extend the existing inner tubular so that the casing head can be installed on the casing at the well. Also, operators need to be able to isolate the inner tubular from the surrounding casing.

To do this, operators attach the slip apparatus to a joint tubular that will extend the inner tubular. The slip apparatus has an inner sleeve that threads onto the joint tubular. Operators then fit collet members on this inner sleeve onto the inner tubular so the joint tubular extends from the inner tubular. A groove for an O-ring seal and a shoulder can be defined inside the inner sleeve where it fits onto the inner tubular.

Operators also fit an outer sleeve of the slip apparatus onto the inner sleeve and thread a collet onto the inner sleeve.

Preferably, the outer sleeve and the collet are separate components that when assembled together allow the collet to rotate while the outer sleeve does not. Although other arrangements are possible, the collet and outer sleeve can have interlocking lips in a tongue-and-groove or shoulder-to-shoulder arrangement.

When the collet thread onto the inner sleeve, the collet forces the outer sleeve to engage the collet members around the inner tubular. The collet members on the inner sleeve preferably have wedged outer surfaces that help to force the collet members into the inner tubular when pushed by the outer sleeve. In addition, the collet members preferably have teeth on their inner surfaces that bite into the inner tubular when forced against it. To lock the outer sleeve to the inner sleeve, threaded holes in the outer sleeve can receive bolts or the like that engage the inner sleeve to hold the two sleeves together.

Once the slip apparatus extends the joint tubular from the inner tubular, operators mount the no-weld casing head on the outer casing at the well site so that the joint tubular extends through the bowl of the casing head. Then, operators install a pack-off element, such as an H-plate, around the joint tubular in the casing head and install a second pack-off on a distal end of the joint tubular. Finally, operators install other wellhead components, such as a tubing spool, on the casing head. The second pack-off element on the end of the joint tubular engages inside the tubing spool to complete the isolation of the inner tubular from the surrounding casing at the well.

DETAILED DESCRIPTION

Figure 1:
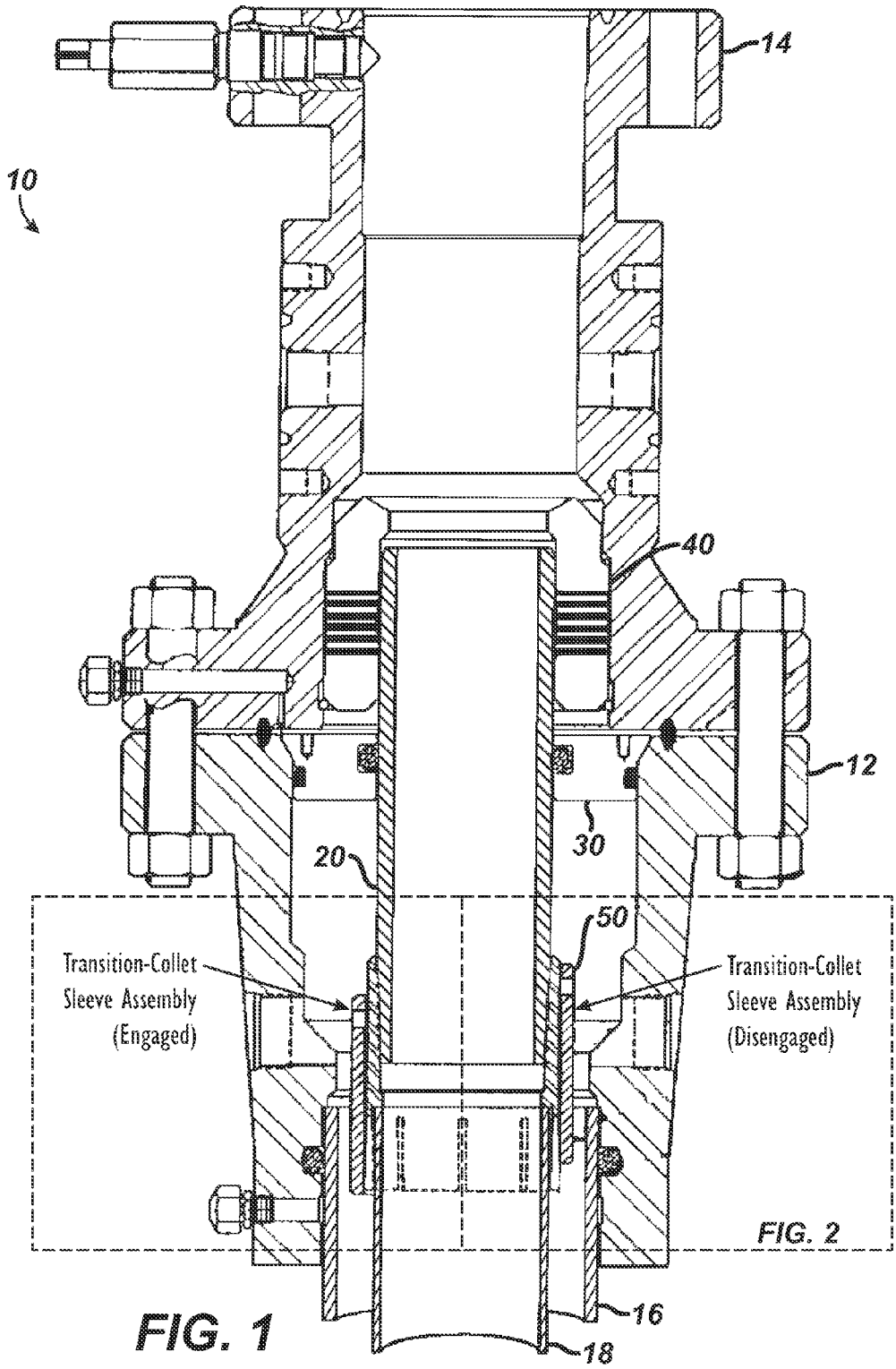
FIG. 1 is a cross-sectional view of a wellhead having a power slip assembly according to the present disclosure.

An outer casing 16 in FIG. 1 runs down a wellbore and has inner tubing 18 disposed inside. Typically, the outer casing 16 is cemented in place in the wellbore, and the inner tubing 18 is cemented or hung inside the outer casing 16 for further isolation. A wellhead 10 installs on the outer casing 16 and has a casing head 12. A tubing spool 14 installs above this casing head 12, although other conventional equipment can be supported above the head 12 in addition to or in place of the spool 14.

As shown in FIG. 1, the casing head 12 is a "no-weld" casing head (also known as a sleeve-type casing head) that has been used to replace the original wellhead after damage. To fix the damaged wellhead, operators have removed the original casing head and cut-down the exposed casing 16 so that this "no-weld" casing head 10 can be installed. Because this well has the inner tubing 18 disposed inside the casing 16, operators need to isolate the inner tubing 18 from the outer casing 16 within the casing head 12.

As noted previously, installing the no-weld casing head 12 and isolating the inner tubing 18 from the outer casing 16 can prove difficult for operators in the field. To alleviate problems, operators use a power slip assembly 50 shown in FIG. 1 inside the casing head 12. This power slip assembly 50 (shown in more detail of FIG. 2) supports a joint tubular 20 that extends from the inner tubing 18. This joint tubular 20 along with pack-off elements 30/40 isolate the other components of the wellhead (e.g., tubing spool 14) from the outer casing 16 when the no-weld casing head 12 is installed.

Figure 2:
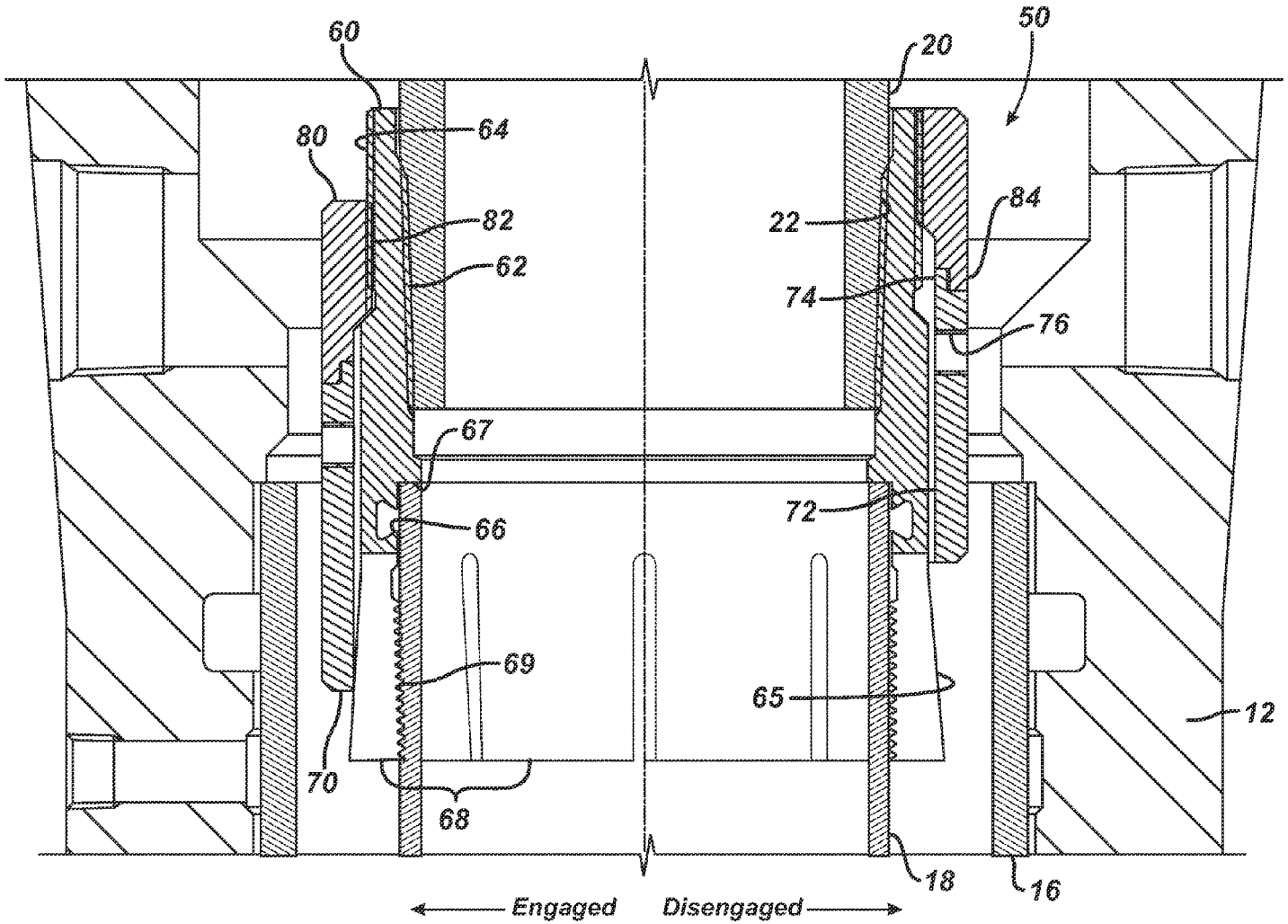
FIG. 2 is a detail of the power slip assembly in FIG. 1 installed in a casing head.

Operators use the power slip assembly 50 with the "no-weld" casing head 12 on the casing 16 and the inner tubing 18 by performing the following steps. First, when the damaged casing head (not shown) originally on the casing 16 is removed, operators cut and prep the casing 16 and inner tubing 18 to the proper lengths and finish. Prior to attaching the "no-weld" casing head 12 to the outer casing 16, operators first fit the power slip assembly 50 onto the inner tubing 18. In particular and as best shown in FIG. 2, operators thread the inner sleeve 60 onto the threaded end of the joint tubular 20, which is the piece of tubing intended to extend the length of the inner tubing 18. Then, operators pre-assemble the outer sleeve 70 and the collet 80 together and position the assembled sleeve/collet 70/80 onto the joint tubular 20.

Next, operators fit the distal end of the inner sleeve 60 over the exposed stub of the inner tubing 18. Using an appropriate tool, operators then lock the power slip assembly 50 onto the inner tubing 18 as described in more detail below. At this point, the joint tubular 20 extends vertically from the inner tubing 18. As best shown in FIG. 1, operators complete the wellhead installation by installing the casing head 12 on the casing 16 and fitting an H-plate 30 into the open bowl of the head 12 to pack-off the joint tubular 20. A secondary pack-off 40 fits onto the end of the joint tubular 20, and the tubing spool 14 or other component installs on the casing head 12 so that the secondary pack-off 40 engages inside the spool 14. Finally, operators install other components to complete the wellhead 10.

As noted above, the power slip assembly 50 allows operators to secure and extend the existing inner tubing 18 with the joint tubular 20 so the casing head 12 and other components can be isolated from the casing 16 once installed. Further details of how the power slip assembly 50 couples the joint tubular 20 to the inner tubing 18 are discussed below with reference to FIGS. 2-5.

Figure 3:
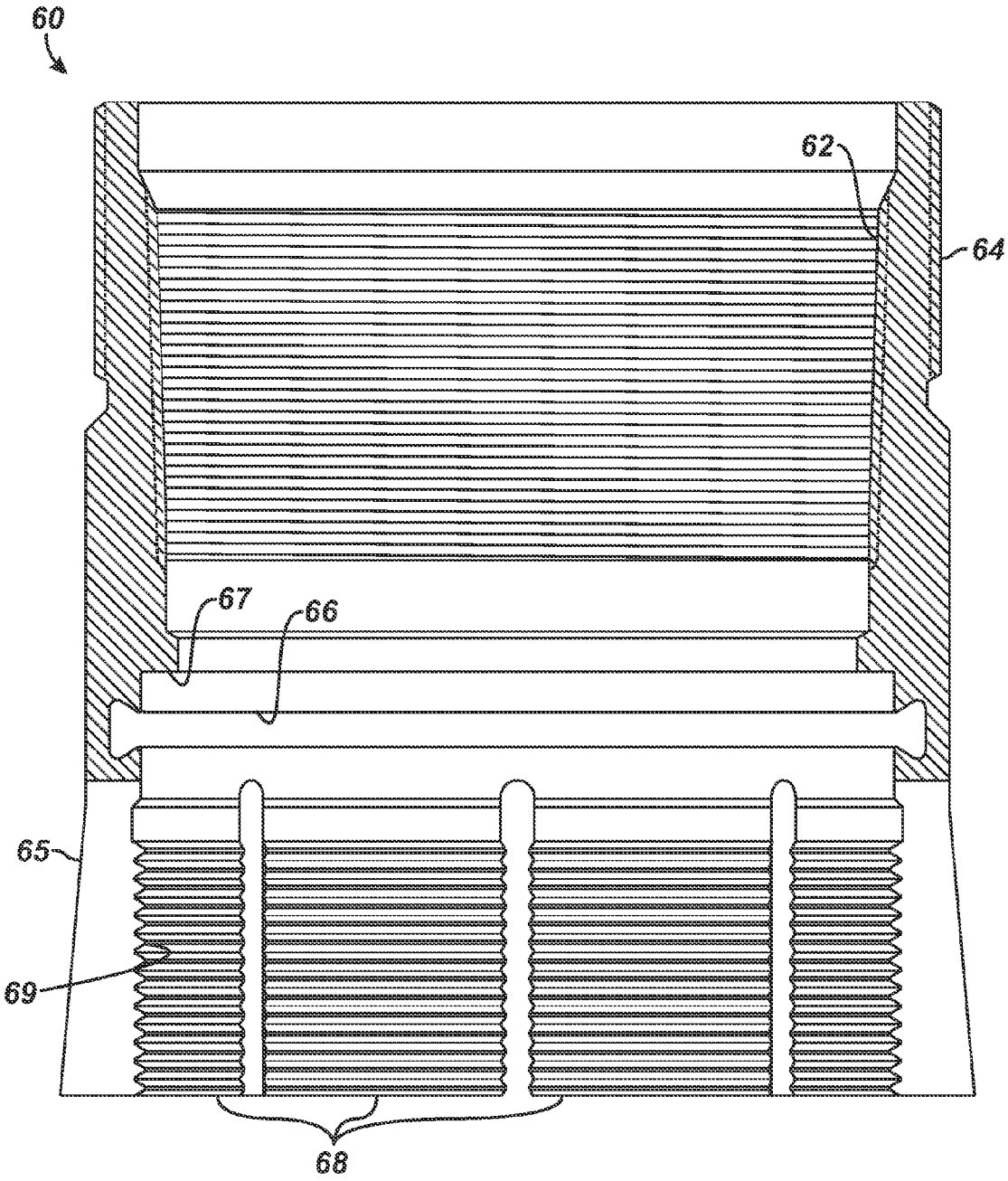
FIG. 3 is a cross-section of an inner sleeve for the power slip assembly.

The inner sleeve 60—shown in detail in FIG. 3—has inner thread 62 that threads onto external thread 22 on the end of the joint tubular 20. The inner sleeve 60 also has an inner groove 66 for an O-ring seal (not shown) and has a shoulder 67 that engage the distal end of the inner tubing 18 when positioned thereon (See FIG. 2). At its lower end, the inner sleeve 60 has a plurality of collet members or fingers 68 that flex on the sleeve 60 and that fit around the distal end of the inner tubing 18 (See FIG. 2).

Outer wedge profiles 65 on these collet members 68 allow the members 68 to be forced against the inner tubing 18 so that teeth 69 on the inside of the collet members 68 bit into the tubing 18's outer surface. These inner teeth 69 can take many forms. For example, the teeth 69 can be vee-thread and can have concentric grooves, as shown in FIG. 3. Alternatively, the teeth 69 can be spiraled or threaded so that the inner sleeve 60 can be somewhat threaded onto the tubing 18's distal end.

As noted previously and shown in FIG. 2, the outer sleeve 70 and the collet 80 fit onto the inner sleeve 60. The outer sleeve 70—shown in detail in FIG. 4—has a cylindrical inner surface 72 that can be forced against the outer wedge profiles 65 on the inner sleeve's collet members 68. Threaded holes 76 in the side of the sleeve 70 can receive locking bolts (not shown) or the like. When the outer sleeve 70 is positioned on the inner sleeve 60, bolts in these holes 76 can engage the inner sleeve 60 to lock the two sleeves 60/70 together.

Figure 5:
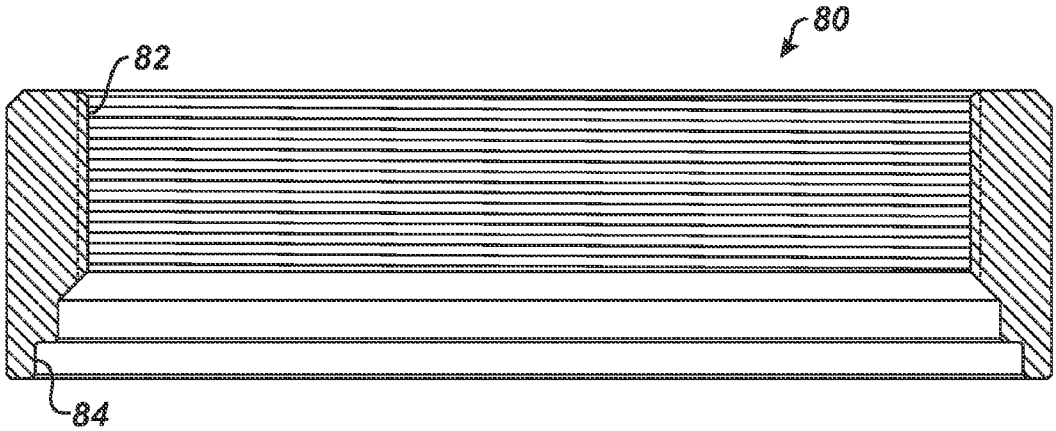
FIG. 5 is a cross-section of an interlocking drive collet for the power slip assembly.

The sleeve 70's lipped upper end 74 mates with a lipped lower end 84 of the collet 80—shown in detail in FIG. 5. Matting between the lipped ends 74/84 may use a tongue-and-groove or a shoulder-to-shoulder arrangement that allows the collet 80 to rotate relative to the outer sleeve 70 while maintaining the lipped ends 74/84 connected. When the collet 80 positions on the inner sleeve 70 as shown in FIG. 2, the collet 80's inner thread 82 mates with the external thread 64 on the inner sleeve 60. When initially installed, the power slip assembly 50 has a disengaged condition, as best shown on the right side of FIG. 2.

As the collet 80 is threaded onto the inner sleeve 60, the collet 80 moves the outer sleeve 70 down along the inner sleeve 60 and forces the collet members 68 into the tubing 18. The collet 80 threads onto the inner sleeve 60 by rotating the collet 80 counter-clockwise using an appropriate tool. Actually rotating the collet 80 can be performed in a number of ways. For example, operators can use a spanner or bar inserted into holes (not shown) provided in the sides or top of the collet 80 so it can be rotated.

Because the outer sleeve 70 and collet 80 are connected together by lipped ends 74 and 84, the collet 80 is allowed to rotate even though the outer sleeve 70 may not rotate. Rotating the collet 80, however, drives the outer sleeve 70 downward, allowing its inner surface 72 to engage the wedge profiles 65 of the collet members 68 on the inner sleeve 60. As the collet members 68 are forced inward by the downward moving outer sleeve 70, the member's inner teeth 69 bite into the tubing 18. The left side of FIG. 2 shows the power assembly 50 in this engaged condition.

For exemplary dimensions, the casing 16 may have a diameter of 8⅝-in, while the inner tubing 18 may have a diameter of 5½-in. The inner sleeve 60 may have an overall outside diameter of 6.375-in and a length of 7.33-in. The internal thread 62 may accept a 5½-in tubular. The depth of the slots for the collet members 68 may extend a length of 2.33-in, and the wedged profile 65 on the outside of the collet members 68 may be angled at about 5-degrees. The outer sleeve 70 may have an outer diameter of 7.25-in, an inner diameter of 6.535-in, and an overall height of 3.75-in with the lip 74 being 0.25-in. The collet 80 may similarly have an outer diameter of 7.25-in, an inner diameter of 6.25-in for its thread 82, and an overall height of 2.00-in with the lip 84 being 0.25-in. Each of these components can be made of suitable materials for use in a well environment. These dimensions are exemplary. Other implementations for different sized casing or tubular would use different dimensions.

Figure 4:
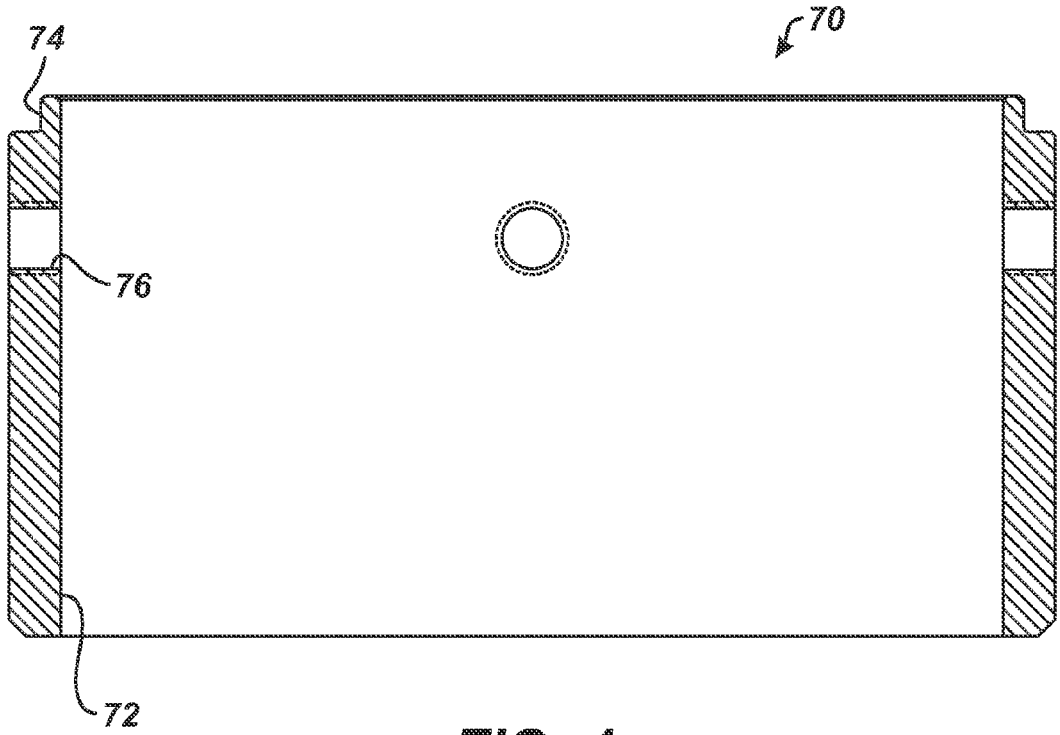
FIG. 4 is a cross-section of an outer sleeve for the power slip assembly.
Figure 6:
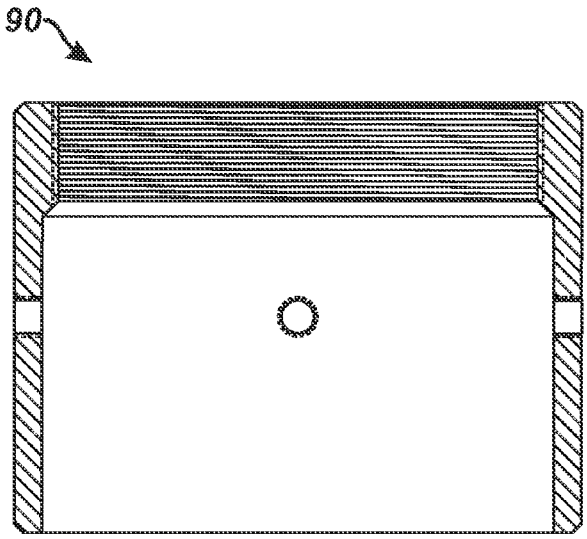
FIG. 6 is a cross-section of a unitary component having a collet portion and an outer sleeve portion.

As shown in FIGS. 4-5, it is preferred that the collet 80 and outer sleeve 70 be separate components. This allows the collet 80 to rotate while the sleeve 70 does not need to rotate as the collet 80 forces it onto the inner sleeve (60). Although separable, it will be appreciated that the collet 80 and sleeve 70 can be combined as a unitary component having a collet portion and a sleeve portion coupled and held together by a rotatable connection. Preferably, the unitary component's sleeve portion is able to rotate relative to the inner sleeve when the component's collet portion is being threaded. Alternatively, a unitary component 90 as shown in FIG. 6 can be used. This component 90 has sleeve and collet portions that rotate together.

In general, the power slip assembly 50 can be used in any application where conventional slips are used to secure and/or extend an existing conductor, casing, or tubing. For example, the power slip assembly 50 can be used in place of conventional slip hangers and can connect to tubing through the BOP/Diverter if needed in various situations. One such situation is when a wellbore tubular (e.g., drill pipe, collar, casing, or other tubular) becomes stuck during drilling, running, or hoisting.

Figure 7:
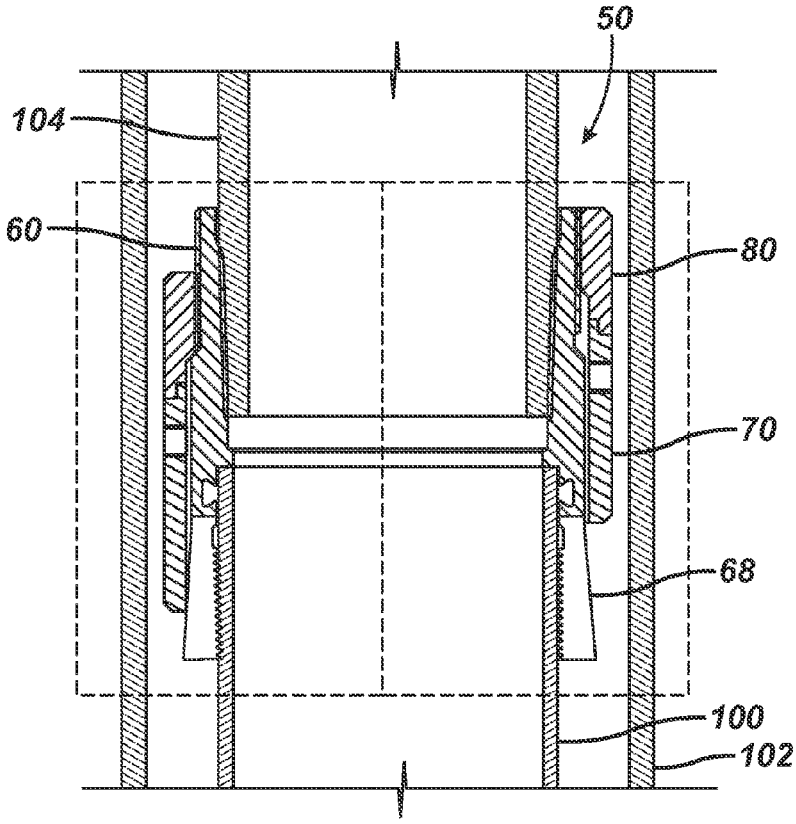
FIG. 7 is a cross-sectional view of the power slip assembly when used for a stuck pipe.

As shown in FIG. 7, for example, a pipe 100 can become stuck in another wellbore tubular 102, such as casing or the like. The power slip assembly 50 can be run through the BOP/Diverter (not shown) without nippling down (disassembling) the BOP/Diverter at the wellhead. In this way, the power slip assembly 50 can secure a joint tubular 104 to the stuck pipe 100 to extend the length of the pipe 100 for suitable pack-off or the like.

To deal with a stuck pipe situation, the end of the stuck pipe 100 can be cut and prepped using techniques known in the art while the wellhead (not shown) remains installed uphole. For example, depending on how accessible the end of the stuck pipe is, a motorized cutting tool, chemical techniques, or radial cutting torches can be used. Operators then attach the power slip assembly 50 on the joint tubular 104 and pass the assembly 50 and joint tubular 104 through the BOP/Diverter without needing to disassemble it. When passed to the stuck pipe 100, the collet members 68 of the inner sleeve 60 fit onto the exposed end of the stuck pipe 100. Then, a running tool (not shown) runs through the BOP/Diverter and engages the collet 80 to rotate it so that it threads onto the inner sleeve 60. As the collet 80 is rotated and threads onto the inner sleeve 60, the outer sleeve 70 forces against the wedge profiles of the collet members 68 causing their teeth to bit into the outside of the stuck pipe 100. When coupling is complete, the running tool (not shown) is removed through the BOP/Diverter, leaving the joint tubular 104 connected to the end of the stuck pipe 100 by the power slip assembly 50. Various pack-off components, slips, and hangers can be installed as needed to isolate and suspend the pipe 100 and the joint tubular 104 in the casing 102.

In this sense, the power slip assembly 50 can be set in a less time-consuming and less precarious manner than used for setting conventional slips in such situations. Moreover, the power slip assembly 50 can be set in place even though a drill collar may be in the way. As is known, having a collar stuck in the bowl of a casing head prohibits the use of conventional slip hangers, which require operators to spear and stretch the casing first. Ultimately, the power slip assembly 50 is less costly, easier, and quicker to set than convention slips used in the art.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A remedial assembly method for a wellhead having an inner tubular disposed in an outer casing, the method comprising:

preparing an end of the inner tubular unable to be packed off inside the wellhead;

attaching a proximal end of a joint tubular to a first sleeve;

extending the joint tubular from the inner tubular by installing the first sleeve on the end of the inner tubular;

installing a second sleeve on the first sleeve;

engaging collet members on the first sleeve around the end of the inner tubular by— attaching a collet onto the first sleeve, and forcing the second sleeve against the collet members with the collet; and packing off the joint tubular in the wellhead.

2. The method of claim 1, wherein packing off the joint tubular in the wellhead comprises installing a pack-off around the joint tubular in a casing head of the wellhead.

3. The method of claim 2, wherein installing the pack-off comprises installing an H-plate around the joint tubular in an open bowl of the casing head.

4. The method of claim 2, wherein packing off the joint tubular in the wellhead comprises:

disposing a pack-off element on a distal end of the joint tubular;

installing a wellhead component on the casing head; and engaging the pack-off element inside the wellhead component installed on the casing head.

5. The method of claim 1, wherein installing the first sleeve on the end of the inner tubular comprises fitting the collet members on the end of the inner tubular.

6. The method of claim 1, wherein attaching the collet onto the first sleeve comprises threading the collet onto the first sleeve.

7. The method of claim 1, wherein forcing the second sleeve against the collet members with the collet comprises moving the second sleeve over the collet members as the collet threads onto the first sleeve.

8. The method of claim 7, wherein moving the second sleeve over the collet members as the collet threads onto the first sleeve comprises allowing the second sleeve to move axially as the collet rotates.

9. The method of claim 1, wherein preparing the end of the inner tubular comprises cutting down the end of the inner tubular while stuck inside the outer casing.

10. The method of claim 1, wherein preparing the end of the inner tubular comprises:

removing a damaged wellhead from the outer casing having the inner tubular disposed therein; and cutting down the ends of the outer casing and the inner tubular.

11. The method of claim 10, further comprising installing a casing head on the end of the outer casing with the joint tubular positioned in the casing head.

12. The method of claim 11, wherein the method further comprises installing a wellhead component onto the casing head, and wherein packing off the joint tubular in the wellhead comprises disposing a pack-off element on a distal end of the joint tubular and engaging the pack-off element inside the wellhead component installed on the casing head.

13. A remedial wellhead assembly method, comprising:

exposing ends of an outer casing and an inner tubulars disposed therein at a surface of a wellbore;

attaching an inner sleeve onto a proximal end of a joint tubular;

extending the joint tubular from the inner tubular by disposing the inner sleeve on the exposed end of the inner tubular;

disposing an outer sleeve on the joint tubular against the inner sleeve;

engaging collet members on a distal end of the inner sleeve against the exposed end of the inner tubular by moving the outer sleeve along the inner sleeve;

installing a casing head of a wellhead on the outer casing with the joint tubular extending beyond the casing head; and packing off the joint tubular in the wellhead.

14. The method of claim 13, wherein exposing the ends of the outer casing and the inner tubular comprises:

removing an existing casing head from the outer casing; and cutting down the ends of the outer casing and the inner tubular.

15. The method of claim 13, wherein the casing head installing onto the outer casing comprises a no-weld casing head.

16. The method of claim 13, wherein engaging the collet members on of the inner sleeve against the exposed end of the inner tubular comprises disposing the collet members onto the exposed end; and pressing the collet members inward around the exposed end.

17. The method of claim 13, wherein packing off the joint tubular in the wellhead comprises installing a pack-off component around the joint tubular in an open bowl of the casing head.

18. The method of claim 13, wherein installing the casing head further comprises installing a wellhead component on the casing head.

19. The method of claim 18, wherein packing off the joint tubular in the wellhead comprises disposing a pack-off component on a distal end of the joint tubular and engaging the pack-off component inside the wellhead component installed on the casing head.

20. The method of claim 13, wherein moving the outer sleeve along the inner sleeve comprises forcing the outer sleeve against the collet members on the inner sleeve.

21. The method of claim 13, wherein moving the outer sleeve along the inner sleeve comprises threading a rotating portion of the outer sleeve on the inner sleeve and moving a sliding portion of the outer sleeve along the inner sleeve.

22. A remedial assembly for a wellhead having an inner tubular disposed inside an outer casing, the inner tubular having an end unable to be packed off inside the wellhead, the assembly comprising:

a joint tubular having proximal and distal ends and installed above the inner tubular with the proximal end adjacent the end of the inner tubular;

an inner sleeve attached to the proximal end of the joint tubular and having a plurality of flexible collet members, the flexible collet members disposed around the end of the inner tubular;

an outer sleeve movably disposed on the inner sleeve and engaging with the flexible collet members; and a collet rotatably disposed on the inner sleeve and forcing the outer sleeve to engage the flexible collet members against the end of the inner tubular, wherein the joint tubular extends the inner tubular relative to the outer casing and extends the distal end into the wellhead for being packed-off therein.

23. The assembly of claim 22, wherein the outer casing has a cut-down end from which a damaged casing head has been removed; and wherein the assembly further comprises a casing head having a first bore installed on the cut-down end of the outer casing, the distal end of the joint tubular extending beyond the casing head.

24. The assembly of claim 23, further comprising one or more pack-off components positioning in the casing head and packing-off the joint tubular from the first bore of the casing head.

25. The assembly of claim 24, wherein the one or more pack-off components comprise an H-plate positioning around the joint tubular in an open bowl of the first bore of the casing head.

26. The assembly of claim 23, wherein the wellhead has a wellhead component installed on the casing head, the distal end of the joint tubular disposed in the wellhead component; and wherein the assembly further comprises a pack-off element positioning on the distal end of the joint tubular and engaging inside the wellhead component installed on the casing head.

27. The assembly of claim 22, wherein the inner sleeve has first and second ends, the first end having the flexible collet members, the second end having an external thread threadable to the collet and having an internal thread threadable to the proximal end of the joint tubular.

28. The assembly of claim 27, wherein the collet has an internal thread threadable to the external thread on the inner sleeve.

29. The assembly of claim 22, wherein the outer sleeve is movable by engagement with the collet and has an inner surface engageable against the flexible collet members on the inner sleeve.

30. The assembly of claim 29, wherein the collet is threadable onto the inner sleeve to force the outer sleeve's inner surface against outer surfaces of the flexible collet members.

31. The assembly of claim 30, wherein inner surfaces of the flexible collet members comprise teeth engageable with the outside of the end of the inner tubular.

32. The assembly of claim 30, wherein the outer surfaces of the flexible collet members define wedge profiles engagable by the inner surface of the outer sleeve.

33. The assembly of claim 22, wherein engagement between the collet and the outer sleeve allows the collet to rotate relative to the outer sleeve.

34. The assembly of claim 33, wherein the collet has a first lip engageable with a second lip on the outer sleeve.

35. The assembly of claim 22, wherein the inner sleeve and the collet comprise a unitary component.

* * * * *

UNITED STATES PATENT AND TRADEMARK OFFICE

CERTIFICATE OF CORRECTION

PATENT NO. : 8,479,824 B2
APPLICATION NO. : 12/565009
DATED : July 9, 2013
INVENTOR(S) : Travis et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 392 days.

Signed and Sealed this
Twenty-third Day of December, 2014

Michelle K. Lee

Michelle K. Lee
*Deputy Director of the United States Patent and Trademark Office*